US006332515B1

(12) United States Patent
Sauter

(10) Patent No.: US 6,332,515 B1
(45) Date of Patent: Dec. 25, 2001

(54) TRUCK MOUNTED BRAKE BEAM

(75) Inventor: Jeffrey F. Sauter, Lowville, NY (US)

(73) Assignee: New York Air Brake Corp., Watertown, NY (US)

( * ) Notice: Subject to any disclaimer, the term of this patent is extended or adjusted under 35 U.S.C. 154(b) by 0 days.

(21) Appl. No.: 09/654,523

(22) Filed: Sep. 1, 2000

Related U.S. Application Data

(63) Continuation-in-part of application No. 09/046,847, filed on Mar. 13, 1998, now Pat. No. 6,155,387, which is a continuation-in-part of application No. 08/874,228, filed on Jun. 13, 1997, now Pat. No. 5,947,236.

(51) Int. Cl.[7] ..... B61H 13/00

(52) U.S. Cl. ..... 188/219.1; 188/33; 188/153 R; 188/207

(58) Field of Search ..... 188/52, 233.3, 188/198, 219.1, 107, 33, 47, 202, 153 R, 153 D, 153 A, 207, 209, 205 R, 235, 236, 226.1, 212, 213

(56) References Cited

U.S. PATENT DOCUMENTS

| | | | |
|---|---|---|---|
| 568,044 | | 9/1896 | Robischung . |
| 575,420 | | 1/1897 | Farley . |
| 715,518 | | 12/1902 | Simpson . |
| 729,924 | | 6/1903 | Frost . |
| 749,567 | | 1/1904 | Lamont . |
| 794,404 | | 7/1905 | Green . |
| 796,714 | | 8/1905 | Frost . |
| 979,968 | | 12/1910 | Kofske . |
| 1,144,403 | | 6/1915 | Williams, Jr. . |
| 1,203,469 | | 10/1916 | Busse . |
| 1,301,433 | | 4/1919 | Hedgcock . |
| 1,498,176 | | 6/1924 | Lachman . |
| 2,116,594 | | 5/1938 | Busch . |
| 2,182,210 | | 12/1939 | Osner et al. . |
| 2,277,615 | | 3/1942 | Townsend . |
| 2,329,247 | | 9/1943 | Busse et al. . |
| 2,480,857 | | 9/1949 | Hess . |
| 2,491,086 | | 12/1949 | Busch . |
| 2,517,199 | | 8/1950 | Gothberg . |
| 2,885,036 | | 5/1959 | Walker . |
| 3,365,852 | | 1/1968 | Pitillo . |
| 3,499,507 | | 3/1970 | Scott et al. . |
| 3,780,837 | * | 12/1973 | Haydu ..... 188/107 |
| 3,907,078 | | 9/1975 | Means . |
| 4,653,812 | | 3/1987 | Engle . |
| 4,766,980 | | 8/1988 | Engle . |
| 4,771,868 | | 9/1988 | Haydu . |
| 4,793,446 | | 12/1988 | Hart et al. . |
| 5,069,312 | | 12/1991 | Kanjo et al. . |
| 5,400,874 | | 3/1995 | Gayfer et al. . |
| 5,495,921 | | 3/1996 | Samulak et al. . |
| 5,785,159 | * | 7/1998 | Jackson et al. ..... 188/219.1 |
| 5,806,634 | | 9/1998 | Engle . |
| 5,810,124 | | 9/1998 | Sandmann . |
| 5,901,819 | | 5/1999 | Engle . |
| 5,947,236 | | 9/1999 | Sauter . |
| 6,155,387 | * | 12/2000 | Sauter . |
| 6,176,354 | * | 1/2001 | Sauter et al. . |

* cited by examiner

*Primary Examiner*—Douglas C. Butler
(74) *Attorney, Agent, or Firm*—Barnes & Thornburg

(57) ABSTRACT

A brake system for a railroad vehicle having first and second brake beams, two levers pivotally mounting an actuator to the first beam and push rods connecting the levers to the second beam. The first and second brake beams each include a pair of vertically spaced beam members. The levers are mounted to the first brake beam in the space between the beam members to pivot in a plane offset from a center plane of the space. Also, the first and second push rods are mounted to the second brake beam in the space between the beam members to pivot in a plane also offset from the center plane of the space.

7 Claims, 5 Drawing Sheets

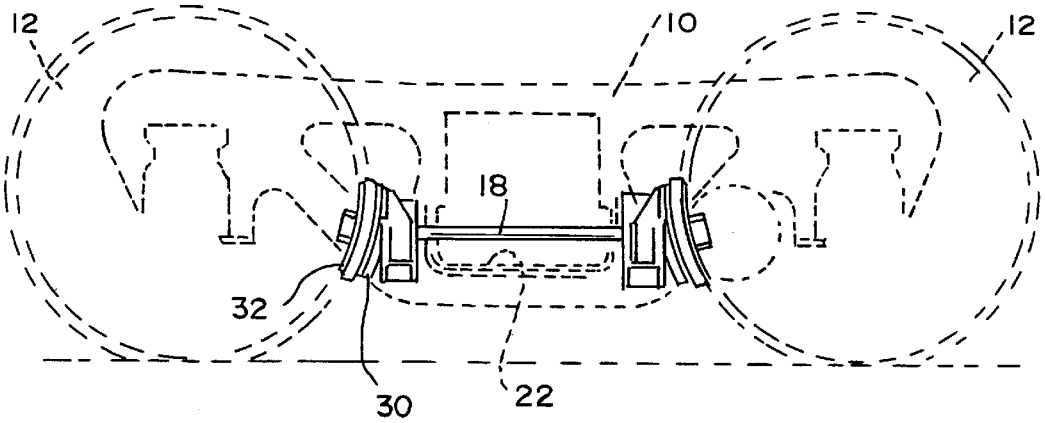
FIG. 2
FIG. 1
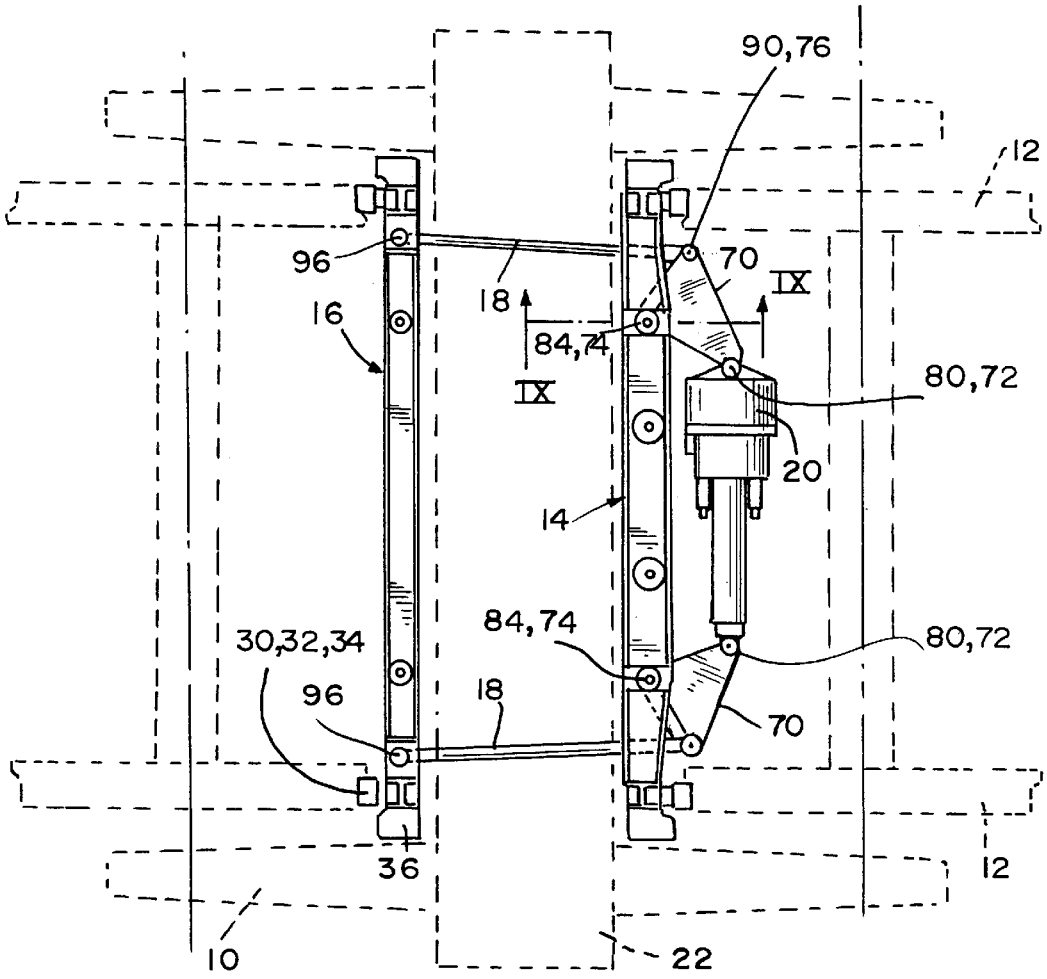

TRUCK MOUNTED BRAKE BEAM

CROSS REFERENCE

This is a continuation-in-part of U.S. application Ser. No. 09/046,847, filed Mar. 13, 1998, now U.S. Pat. No. 6,155,387 which is a continuation-in-part of U.S. application Ser. No. 08/874,228, filed Jun. 13, 1997, now U.S. Pat. No. 5,947,236.

BACKGROUND AND SUMMARY OF THE INVENTION

The present invention relates generally to brake apparatus for rail cars, and more specifically to truck mounted brake apparatus.

Truck mounted brakes throughout the railroad industry include either a double actuator system as illustrated in U.S. Pat. No. 3,499,507 or a single actuator system as illustrated in U.S. Pat. Nos. 5,400,874 and 5,495,921. In all three of these systems, the actuator rods extend through holes in the bolster of the truck. The primary and secondary beams are unitary cast iron beams. The beams are U-shaped having a vertical base and two horizontal walls extending therefrom. The actuator or actuators are mounted to the vertical base and the actuator rods are mounted and extend through openings also in the vertical base.

Another example of a truck mounted brake having a single actuator is illustrated in U.S. Pat. Nos. 4,766,980 and 4,653,812. By moving the actuator rods outside of the center section, they pass under the bolster of the truck and no holes through the bolsters are required. The brake beams are shown as having a rolled steel center channel section with end sections having cast brake shoe heads and projecting guide feet bolted to the center section. As with the previous unitary beams, the channeled portion is generally U-shaped having a vertical base wall with two opposed horizontal walls extending therefrom.

There is a continuous drive to reduce the cost, size and weight of the truck mounted brake and make they adaptable for other track gages and truck configurations.

The present invention relates to a brake system for a railroad vehicle having first and second brake beams, two levers pivotally mounting an actuator to the first beam and push rods connecting the levers to the second beam. The first and second brake beams each include a pair of vertically spaced beam members. The levers are mounted to the first brake beam in the space between the beam members to pivot in a plane offset from a center plane of the space. Also, the first and second push rods are mounted to the second brake beam in the space between the beam members to pivot in a plane also offset from the center plane of the space.

The levers each include a lever element connected to the push rods and the actuator and a sleeve extending from the lever element and pivotally connected to the first beam. The connection of the lever element to the sleeve defines the position of the pivot plane of the lever. The second brake beam includes two pairs of spacers extending from the beam members towards an opposed spacer and the second end of the push rods are mounted between the pair of spacers. The height of the spacers in each pair are unequal to define the position of the pivot plane of the push rods. The spacers are welded to a beam member of the brake beam. One of the spacers may be an angle bracket welded to a beam member.

Other objects, advantages and novel features of the present invention will become apparent from the following detailed description of the invention when considered in conjunction with the accompanying drawings.

BRIEF DESCRIPTION OF THE DRAWINGS

FIG. 1 is a plan view of a truck mounted brake mounted to the truck incorporating the principles of the present invention.

FIG. 2 is a side view of the truck mounted brake of FIG. 1 incorporating the principles of the present invention.

DETAILED DESCRIPTION OF THE PREFERRED EMBODIMENTS

Figures 3, 9:
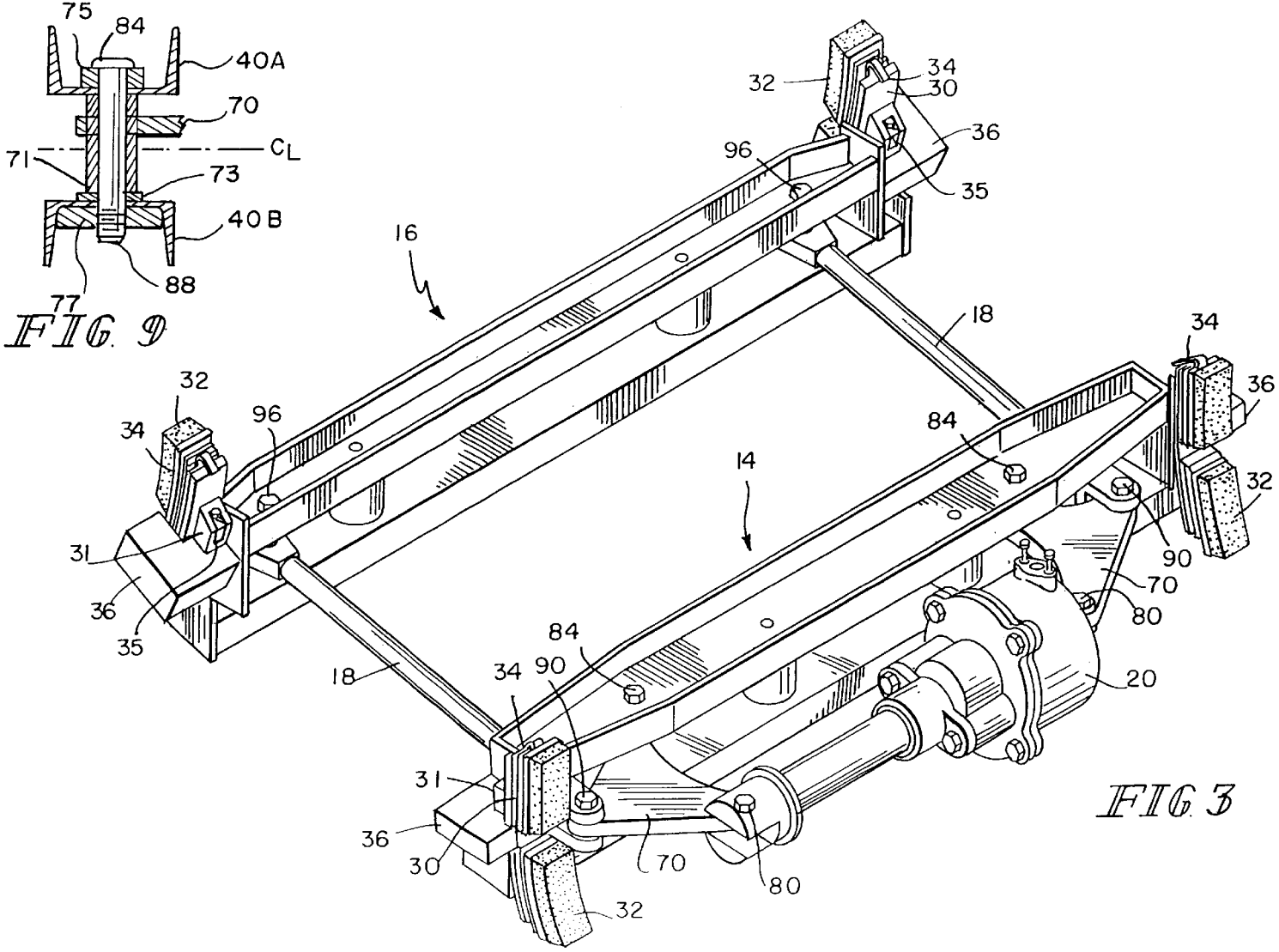
FIG. 3 is a perspective view of an embodiment of a truck mounted brake mounted to the truck incorporating the principles of the present invention.
FIG. 9 is a cross-sectional view taken along line IX—IX of FIG. 1 of the second embodiment of the lever and the primary beam.
Figure 4:
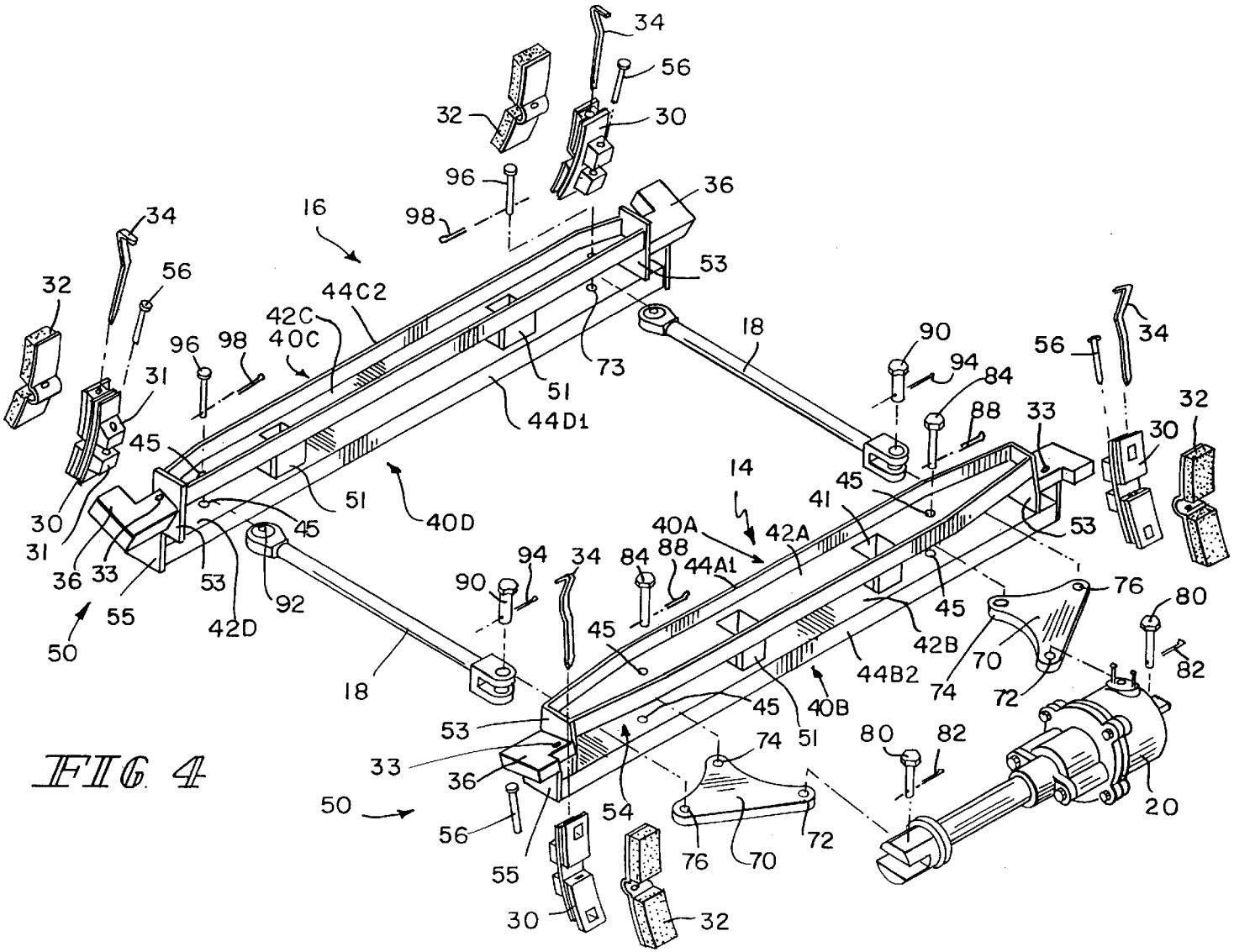
FIG. 4 is an exploded view of the truck mounted brake of FIG. 3.

A truck mounted brake is shown in FIGS. 1 and 2 with respect to bolster 10 of the truck and a wheel 12. The truck mounted brake includes a primary brake beam 14 and a secondary brake beam 16 on opposite sides of the bolster 10 and interconnected by force transmission or push rod assembly 18. An actuator 20 is supported by the primary beam 14 and is connected to the secondary beam 16 by the push rods 18. A spring plank 22 lies below the push rod assembly which must clear the spring plank during operation of the brake.

At each end of the primary beam 14 and the secondary beam 16, is a brake head 30 having brake shoes 32 secured thereto by removable latch 34. Also, extending from the ends of each of the brake beams are guide feet 36 which are received in slots in the side walls of the truck. Each of the brake heads 30 and brake shoes 32 are adjacent to respective wheel 12.

The system so far described is well known in the industry and is illustrated for example, in U.S. Pat. Nos. 4,766,980 and 4,653,812. The operation of the actuator 20, with or without slack adjusters, and the push rod assemblies 18 to operate the pair of brake beams 14 and 16 is well known and will not be described here in detail.

The improved brake beam system of the present invention is illustrated in detail in FIGS. 3–9. The primary beam 14 and the secondary beam 16 each include a center section 40 having two vertically spaced beam members 40A,B and 40C,D respectively. The beam members may be for example channeled elements, each including a horizontal base 42 and pair of vertical side walls 44. In both beams, the base 42 is horizontal and the side walls 44 are vertical. The specific orientation and design of the present center sections 40 allows them to be standard U or C channeled stock of substantially reduced weight compared to that of the prior art brake beams. Also, box channel or rectangular cross-section stock may be used. Although the specific beam members to be described are preferred any pair of vertically spaced beam members may be used.

A pair of first weldments 51 secure the top channeled element 40A,40C to the bottom channeled elements 40B,D. Openings 41 in the base provide access to the hollowed weldments 51 and allows debris and water to run off through the weldments. The top channeled elements 40A,C are shorter in length than the bottom channeled elements 40B,D and are secured to each other at their ends by a second weldment illustrated as a plate 53. The guide feet 36 are secured to the center channeled elements 40 by the weldment 53 and a third weldment 55 connected to the bottom channeled element 40B,D.

Since the guide feet 36 are unitary with the beam structure, the brake head 30 with the brake shoe 32 are removable from the guide feet 36. The brake head includes a pair of spaced blocks 31 on its back wall between which is received a portion of the guide foot. A fastener 56 is extended through aligned apertures 33 in the blocks 31 and the guide foot 36. A cotter pin 57 secures the fastener 56. A tab 35 extending from the top block 31 is bent over the top of the fastener 56 to also secure it in place. Other devices may be used instead of the tab 35. The brake head 30 is secured from lateral movement by the weldment 53 and a transverse wall of the guide foot 36. This would also prevent rotation or swivelling of the brake head 30.

The actuator 20 is supported by the primary brake beam 16 through bell crank lever 70. Opposite ends of the actuator 20 are secured by pins 80 received through aperture 72 in the bell crank lever 70. A cotter pin 82 connected through the end of the pin 80. The bell crank lever 70 is pivotally connected to the end section 50 in opening 54 of the first beam by a pin 84 received in aperture 74. A cotter pin 88 is provided at the end of pin 84 to secure it in place.

One end of the push rod assembly 18 is secured to the bell crank lever 70 by a pin 90 received in aperture 76 of the bell crank lever 70 and a cotter pin 94 holds the pin 90 in place. The other end of the push rod 18 is received and secured to the center section of channeled elements 40C,D of the second beam 16 by pin 96 and cotter pin 98 through bore 45 in base 42. A bushing 92 is provided in the end of the push rod assembly 18.

Preferably, the push rod assembly 18, the bell crank levers 70 and the center line of the actuator 20 lie in a common horizontal plane. Depending upon the design of the truck, this plane will vary. The push rod assembly 18 must clear any truck structure while the actuator 20 and bell crank lever 70 must not only clear any truck structure but also the axle of the wheels during movement of their normal operation. Thus, the plane of rotation with respect to the space between the vertically space beam members 40 may vary. For the example shown in FIG. 2, the spring plank 22 must be cleared by the push rod assembly 18. Due to the arrangement of the brake shoes and beams relative to the truck 10, spring plank 22 and the wheels 12, the plane of the push rod 18, the bell crank lever 70 and actuator 20 must be above the center line of the space between the beam members 40. Two different embodiments of effectuating the non-centered plane are described in FIGS. 5 and 6 and 7–9.

Figure 5:
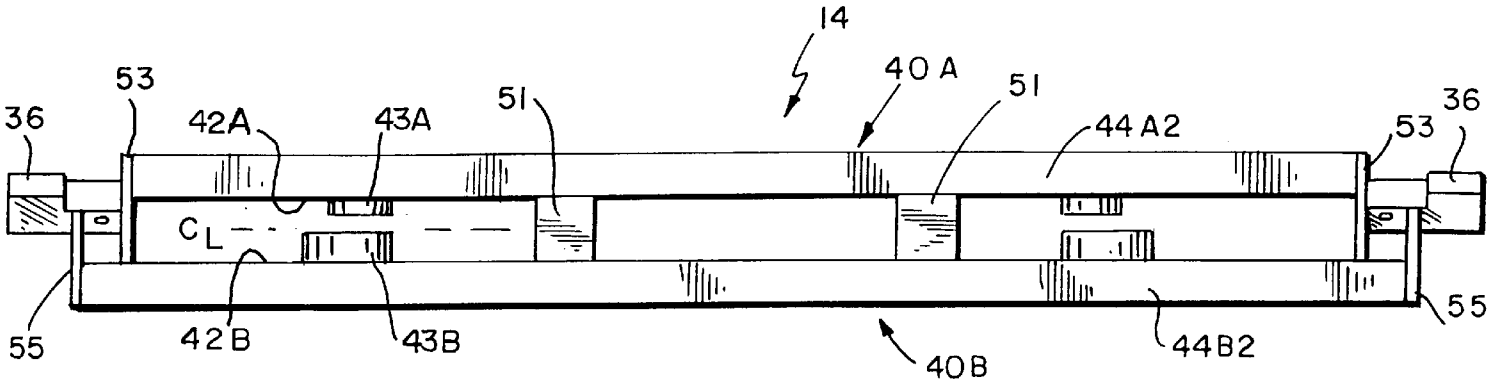
FIG. 5 is a side view of a first embodiment of the primary beam without brake heads incorporating the principles of the present invention.
Figure 6:
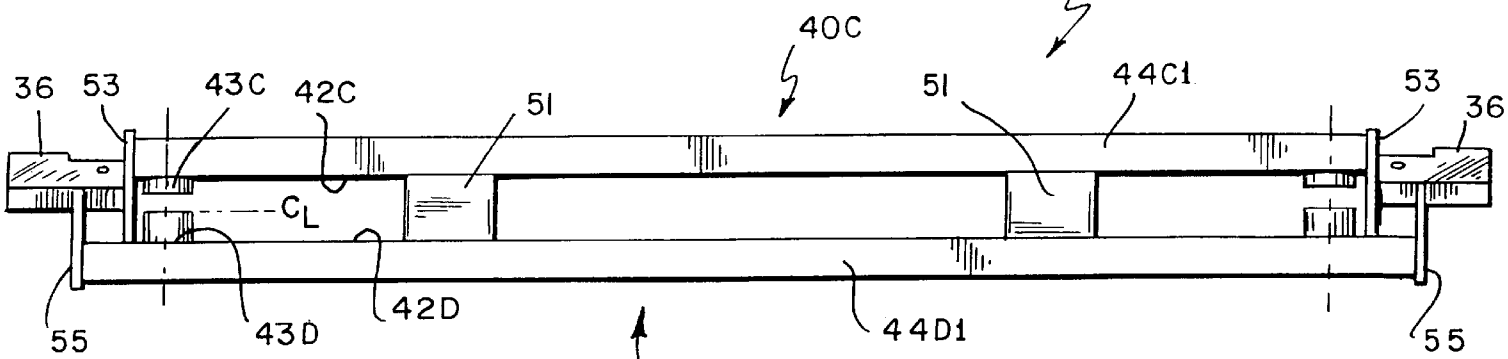
FIG. 6 is a side view of the first embodiment of the secondary beam incorporating the principles of the present invention.

In the first embodiments of FIGS. 5–6, bosses 43 are provided on the base 42 and include the bores 45 (not shown in FIGS. 5–6) which receive the fasteners 90 and 96. Bell crank lever 70 is secured and rides between the bosses 43A and 43B shown in FIG. 5 and the end of the actuating push rod 18 is secured to and between the bosses 43C and 43D shown in FIG. 6. For sake of clarity, the bosses 43 are not shown in FIGS. 3 and 4. All of the bosses 43 act as spacers for the actuator and push rod assembly. The bottom bosses 43B and 44D also act as wear plates since they support the bell crank lever 70 and the end of the push rod 18 respectfully. The bosses 43 are mounted or secured to the bases 42 by welding.

The plane of rotation of the bell crank lever 70 defined by the center of the space between bosses 43 is above the center line CL of the space between the beam members 40 as illustrated in FIGS. 5 and 6.

Figure 7:
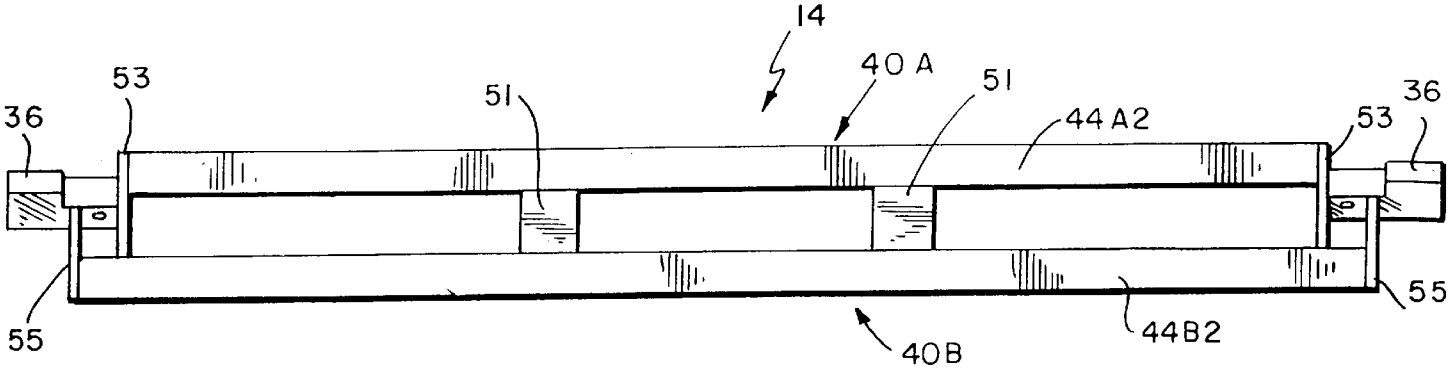
FIG. 7 is a side view of a second embodiment of the primary beam without brake heads incorporating the principles of the present invention.
Figure 8:
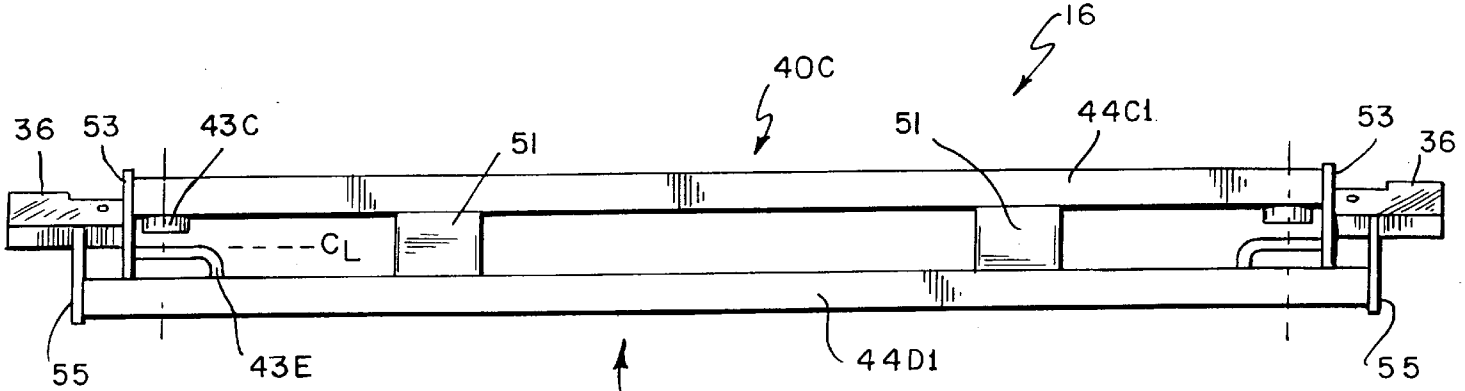
FIG. 8 is a side view of the second embodiment of the secondary beam incorporating the principles of the present invention.

A second embodiment as illustrated in FIGS. 7–9 requires no bosses on the primary beam 14. Instead, as illustrated in FIG. 9, a sleeve 71 extends from the bell crank 70. The sleeve may be welded to the bell crank lever 70. The position of the mounting of the bell crank lever lever 70 to the sleeve 71 defines the plane of rotation. As noted, this is again above the center line CL. A thrust washer 73 is provided between the bottom of the sleeve 71 and the bottom beam member 40B. Spacer 75 is provided between the pin 84 and the upper beam 40A and a spacer 77 is provided at the lower beam member 40B.

The secondary beam 16 illustrated in FIG. 8 includes the upper boss 43C. The bottom boss 43D has been replaced by an angle bracket or boss 43E welded to the weldment 53 and the lower beam member 40D. As in the other embodiments, the center of the space between the bosses 43C and 43E is above the center line CL of the space between the beam members 40C and 40D.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A brake system for a railway vehicle which includes first and second brake beams, first and second levers pivotally mounted to the first beam, an actuator connected to the first and second levers, first and second push rods pivotally connected to the first and second levers respectively at a first end of the push rods and to the second brake beam at a second end of the push rods, wherein:

the first and second brake beams each include a pair of vertically spaced beam members;

the first and second levers are mounted to the first brake beam in the space between the beam members to pivot in a plane off set from a center plane of the space; and the first and second push rods are mounted at their second end to the second brake beam in the space between the beam members to pivot in a plane off set from a center plane of the space.

2. A brake system according to claim 1, wherein the levers each includes a lever element connected to the push rods and the actuator and a sleeve extending from the lever element and pivotally connected to the first beam.

3. A brake system according to claim 1, wherein the connection of the lever element to the sleeve defines the position of the pivot plane of the lever.

4. A brake system according to claim 1, wherein the second beam includes two pairs of spacers extending from the beam members toward an opposed spacer and the second end of the push rods are mounted between a pair of spacers.

5. A brake system according to claim 4, wherein the height of the spacers in each pair are unequal to define the position of the pivot plane of the push rods.

6. A brake system according to claim 4, wherein one of the spacers is an angle bracket welded to a beam member.

7. A brake system according to claim 4, wherein the spacers are welded to a beam member.

* * * * *